US005752870A

United States Patent [19]

Karasawa et al.

[11] Patent Number: 5,752,870

[45] Date of Patent: May 19, 1998

[54] LINE-DRAWING TOY

[75] Inventors: Hideyasu Karasawa, Nagareyama; Asayoshi Asami, Kawasaki; Tadayuki Watanabe, Tokyo, all of Japan

[73] Assignee: Hasbro, Inc., Pawtucket, R.I.

[21] Appl. No.: 622,524

[22] Filed: Mar. 25, 1996

[30] Foreign Application Priority Data

Jun. 15, 1995 [JP] Japan ..... 7-148795

[51] Int. Cl.[6] ..... A63H 13/15

[52] U.S. Cl. ..... 446/146; 33/18.1; 33/27.01; 401/195

[58] Field of Search ..... 33/18.1, 19.3, 33/27.09, 30.7, 26, 27.01; 434/85; 401/195, 131, 258, 259; 446/146

[56] References Cited

U.S. PATENT DOCUMENTS

| | | | |
|---|---|---|---|
| 3,368,319 | 2/1968 | Barlow et al. | 33/18.1 |
| 3,390,460 | 7/1968 | Brown et al. | 33/18.1 X |
| 3,510,949 | 5/1970 | Christy . | |
| 3,613,302 | 10/1971 | Stohrer | 446/146 |
| 3,648,373 | 3/1972 | Morrison et al. | 33/18.1 |
| 3,778,905 | 12/1973 | Jebb et al. | 33/18.1 |
| 4,485,555 | 12/1984 | May et al. | 33/18.1 |
| 4,548,584 | 10/1985 | Townsend . | |
| 4,568,307 | 2/1986 | Gabler et al. . | |
| 4,768,987 | 9/1988 | Usui et al. . | |

FOREIGN PATENT DOCUMENTS

| | | | |
|---|---|---|---|
| 1394248 | 2/1965 | France | 401/195 |
| 52-131142 | 10/1977 | Japan . | |
| 52-171396 | 12/1977 | Japan . | |
| 53-63943 | 5/1978 | Japan . | |

*Primary Examiner*—Robert A. Hafer
*Assistant Examiner*—D. Neal Muir
*Attorney, Agent, or Firm*—Marshall, O'Toole, Gerstein, Murray & Borun

[57] ABSTRACT

The invention disclosed is directed to a line-drawing toy including a base, a wheel rotatably joined to the base that rotates under friction with a contact surface, a leading support joined to the base and spaced apart from the wheel, a pen part operatively joined to the base between the leading support and the wheel, the pen part including at least one pen tip for drawing a line on a contact surface, and a gear mechanism operatively joined to the pen part and the wheel, the gear mechanism having means for converting the rotary motion of the wheel into a predetermined pattern of movement for the pen tips.

6 Claims, 11 Drawing Sheets

LINE-DRAWING TOY

BACKGROUND OF THE INVENTION

A line-drawing toy with a vibrating pen tool attached to the tip of a hollow-case-like grip has been known in the past (Japanese Utility Model to Showa 52-131142, Japanese Utility Model to Showa 53-63943).

This line-drawing toy contains a motor for vibration of the pen tool. Because of the constant vibration of the pen tool, this line-drawing toy can only draw lines of continuous small loops and cannot continuously draw special pattern lines. Moreover, because a motor is required for vibration of the pen tool, this line-drawing toy is expensive and heavy.

The purpose of this invention is to offer a line-drawing toy that can automatically and continuously draw lines of a special pattern without the use of a drive means such as a motor or a battery.

SUMMARY OF THE INVENTION

The present invention provides for a line-drawing toy whereby lines of a set pattern can be automatically and continuously drawn when the toy is moved on a drawing surface to rotate wheels of the line-drawing toy that drive a gear mechanism. Therefore, a drive means such as a battery or a motor is not necessary and there can be no problems with a faulty motor or a dead battery. Further, the toy can be lightweight and can be operated easily and safely.

The present invention provides for a line-drawing toy including: a base; a wheel rotatably joined to the base that rotates under friction with a contact surface; a leading support joined to the base and spaced apart from the wheel, the leading support for supporting the base above a contact surface; a pen part operatively joined to the base between the leading support and the wheel, the pen part including at least one pen tip for drawing a line on a contact surface; and a gear mechanism operatively joined to the pen part and the wheel, the gear mechanism having means for converting the rotary motion of the wheel into a predetermined pattern of movement for the pen tip.

A preferred embodiment of the line-drawing toy includes the leading support having a freely rotatable sphere at its bottom whereby the toy is movable in optional directions.

Another embodiment of the line-drawing toy includes a gear mechanism including a crown gear disposed on a wheel; a gear; means for meshing the crown gear and the gear; and a shaft joined to the gear for rotation therewith, and having means for rotating the pen part.

The gear mechanism may include means to convert the rotary motion of the wheel in one direction into a reciprocal rotary motion whereby lines with complex tracks can be drawn.

The gear provided to the shaft of the pen part may include a clutch mechanism whereby damage of the gear mechanism under abnormal force imposed on the rotation of the wheels or movement of the pen tip can be avoided by relieving such force.

When the line-drawing toy is placed on a drawing surface, leading supports and the end of the pen tip contact the surface. When the toy is moved by hand, the wheels rotate under friction with the contacting surface. This rotation is transmitted to the pen tip by a gear mechanism and the tracks of the pen tip are drawn as lines on the drawing surface.

Various line drawings can be drawn by changing the locations of the pen tips and the composition of the gear mechanism. For example, a large number of different patterns can be drawn by changing the composition of the gear mechanism, the number of gear teeth, the gear ratio between gears, and the number and layout of pen tips. Other interesting patterns can be drawn when the players themselves move the toy in various directions and criss-cross and trace the continuous lines drawn by the pen tips.

DETAILED DESCRIPTION OF THE DRAWINGS

Figure 1:
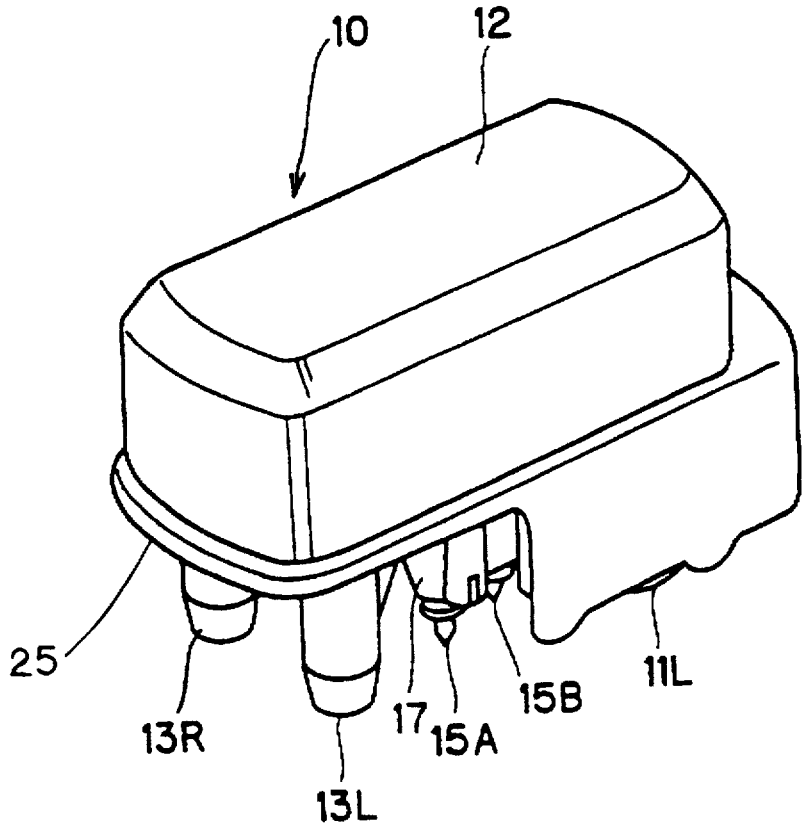
FIG. 1 is a perspective view of the external appearance of one embodiment of this invention.

As illustrated in FIG. 1, line-drawing toy 10 includes cover 12 which is shaped for easy hand manipulation and, preferably, is formed of a transparent material so that the inside gear mechanism is visible from the outside. Under cover 12 is a base 25. Left-hand/right-hand wheels 11L and 11R, two leading supports 13L and 13R located in front of the wheels 11L and 11R, and pen part 17, located between leading supports 13L and 13R and wheels 11L and 11R, all extend downward from the bottom of base 25. Two pen tips 15A and 15B protrude downward from pen part 17. The bottom ends of wheels 11L, 11R, leading supports 13L, 13R, and pen tips 15A, 15B lie substantially in one plane which is preferably defined by a drawing surface.

Figure 2:
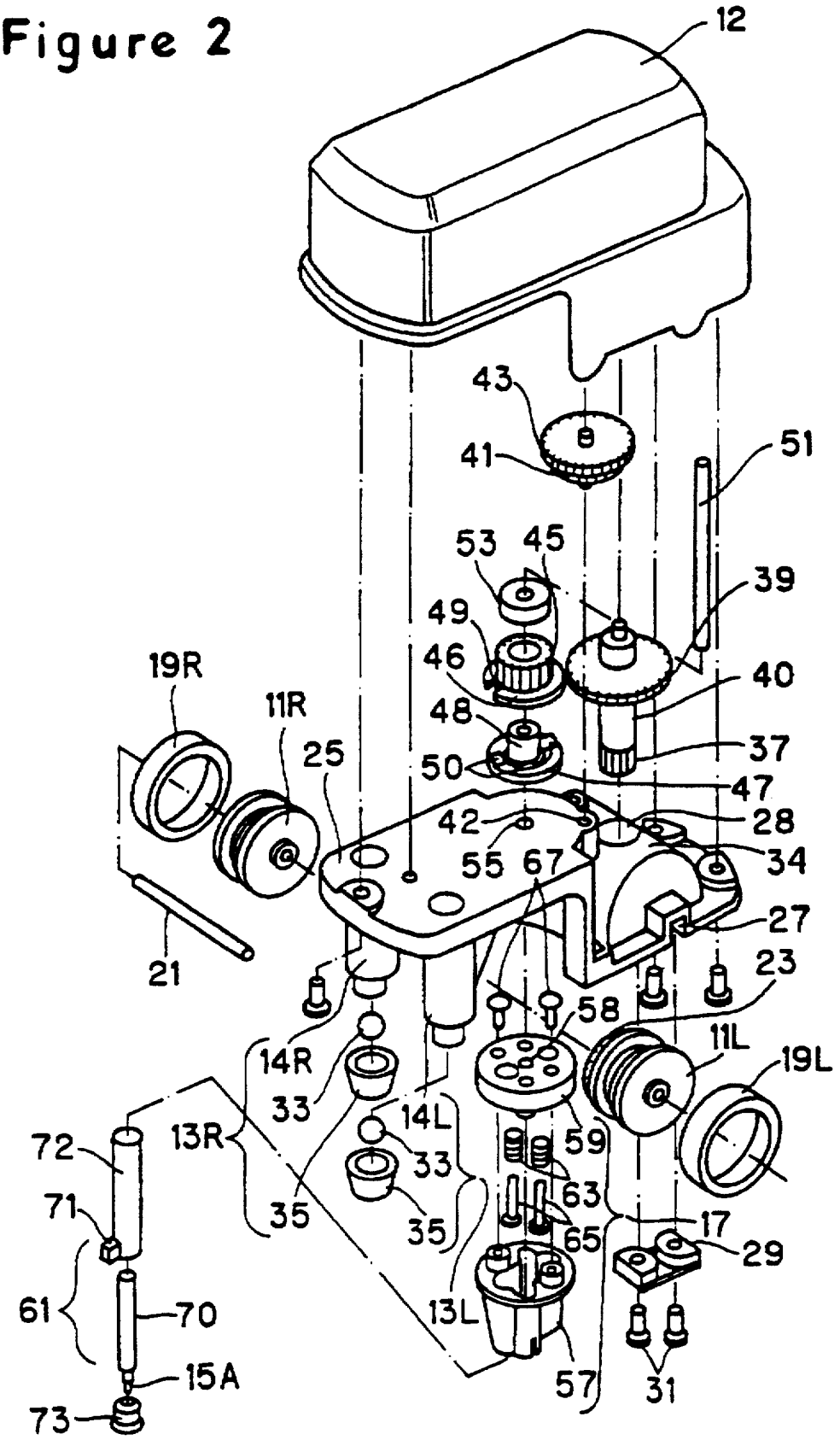
FIG. 2 is an exploded perspective of the line-drawing toy in FIG. 1.

As illustrated in FIG. 2, base 25 is positioned beneath cover 12, and includes a front top part, a rear bottom part and a curved surface 34 that covers the tops of wheels 11L and 11R and protrudes upward from the top of the bottom part of base 25. Bearings 27 are formed at both ends of curved surface 34.

Base 25 also includes two leading supports 13L and 13R which support the top part. Leading supports 13L and 13R together with wheels 11L and 11R support base 25 above a drawing surface. Leading supports 13L and 13R include braces 14L and 14R, spheres 33 and tubular frames 35. Braces 14L and 14R extend downwardly from near the front of the top part of base 25. Tubular frames 35 rotatably attach spheres 33 to the bottom ends of braces 14L and 14R. Spheres 33 act as casters so that a player may move the line-drawing toy 10 in various directions by holding cover 12.

Pen parts 17 are located between leading supports 13L and 13R and wheels 11L and 11R toward the rear of the top part of base 25. As shown in FIG. 2, pen part 17 includes pen 61 with pen tips 15 A (B), pen holder 57, top cover 59 of pen holder 57, and hold-down member 65 that presses pen tip 15 A downward in conjunction with spring 63.

Figure 6:
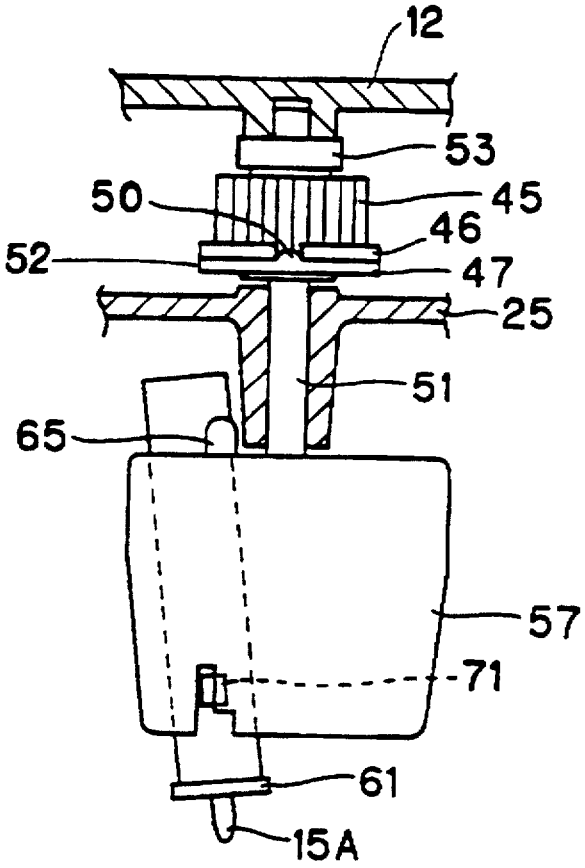
FIG. 6 is a partial side view of the gear and pen holder of the toy in FIG. 1.
Figure 7:
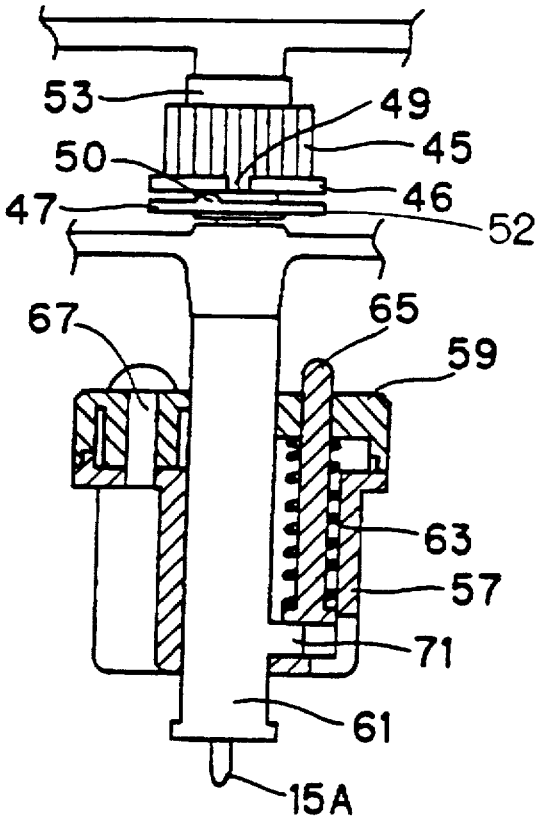
FIG. 7 is a partial cross-section of the pen holder of the toy in FIG. 1.

Pen 61 is preferably a ball-point type ink pen, but may be any other type suitable for use by children. Pen 61 is constructed so that pen core 70 with pen tip 15A at its bottom end is covered by cylinder 72 and bottom stopper 73. Cylinder 72 includes a protrusion 71 at its bottom. As shown in FIGS. 2, 6, and 7, protrusion 71 of cylinder 72 contacts the bottom inside face of pen holder 57 when in use to prevent spring 63 from urging pen 61 out of pen holder 57. To insert pen 61 into pen holder 57, cylinder 72 is inserted into pen holder 57 until protrusion 71 pushes apart the resilient partially bifurcated sidewalls of pen holder 57. The side walls are spread until protrusion 71 clears the inside bottom face of pen holder 57. The side walls then snap back to their normal state to retain pen 61 in holder 57. Side walls of pen holder 57 are positioned closely to protrusion 71 to prevent rotation of pen 61 and spring 63 urges hold-down member 65 downward to keep pen tip 15A in contact with a drawing surface. Pen part 17 is joined to base 25 by shaft rod 51 that is fitted through hole 58 at the center of round top cover 59 of pen part 17.

Figure 8:
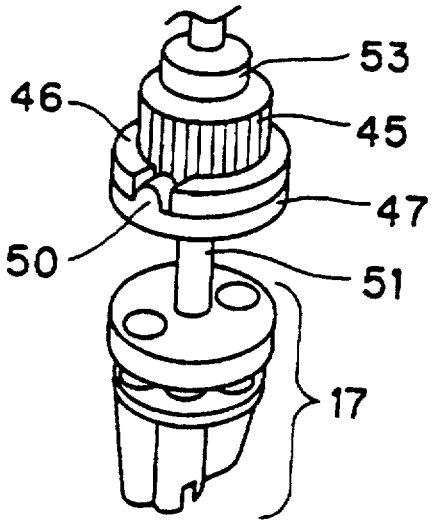
FIG. 8 is a perspective view of the gear and pen holder of the toy in FIG. 1.
Figure 9:
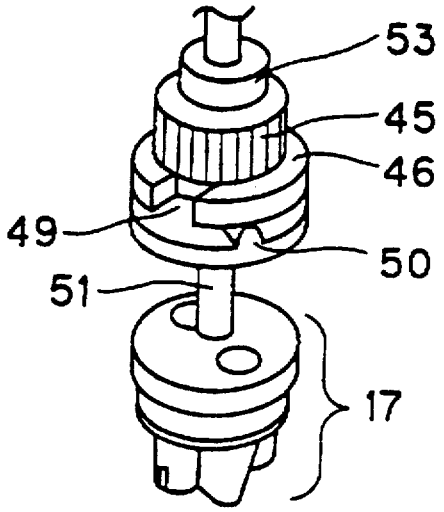
FIG. 9 is a perspective view of the gear and pen holder of the toy in FIG. 1.

FIG. 6 is a side sectional view of gear 45 and pen holder 57 attached to shaft rod 51. FIG. 7 is a partial cross-section of pen holder 57 to which pen 61 is fitted, and FIGS. 8 and 9 are perspectives of gear 45 and the pen holder with base 25 omitted. FIG. 2 illustrates pen holder 57 that is capable of holding two pens. FIGS. 6 and 7 illustrate an embodiment with only one pen 61 fitted into pen holder 57. In FIGS. 8 and 9, pen 61 is not fitted into pen holder 57.

Referring back to FIG. 2, the outer peripheries of wheels 11L and 11R are formed with elastic bodies 19L and 19R that may be smooth, but may be serrated for good traction on a drawing surface. The wheels 11L and 11R are fitted onto axle 21. The ends of axle 21 extend beyond wheels 11L and 11R, and are fitted into the left-hand/right-hand bearings 27 located on base 25. Axle 21 is rotatably joined to base 25 by contact piece 29, which is fastened with screws 31. Alternatively, the contact piece can be a flat bar having one end that fits into a recess in base 25 and is secured with a screw at the other end.

A gear mechanism that converts the rotation of wheels 11L and 11R into a predetermined pattern of pen tips 15A and 15B is disposed on base 25 and covered by cover 12. Crown gear 23 is disposed on the inside face of wheel 11L.

Figure 3:
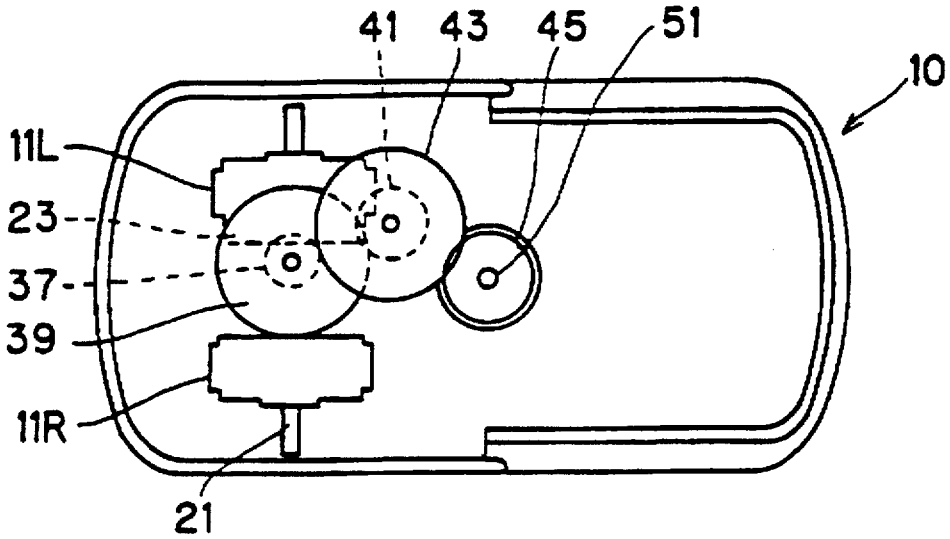
FIG. 3 is a top view of the gear mechanism of the line-drawing toy in FIG. 1.
Figure 4:
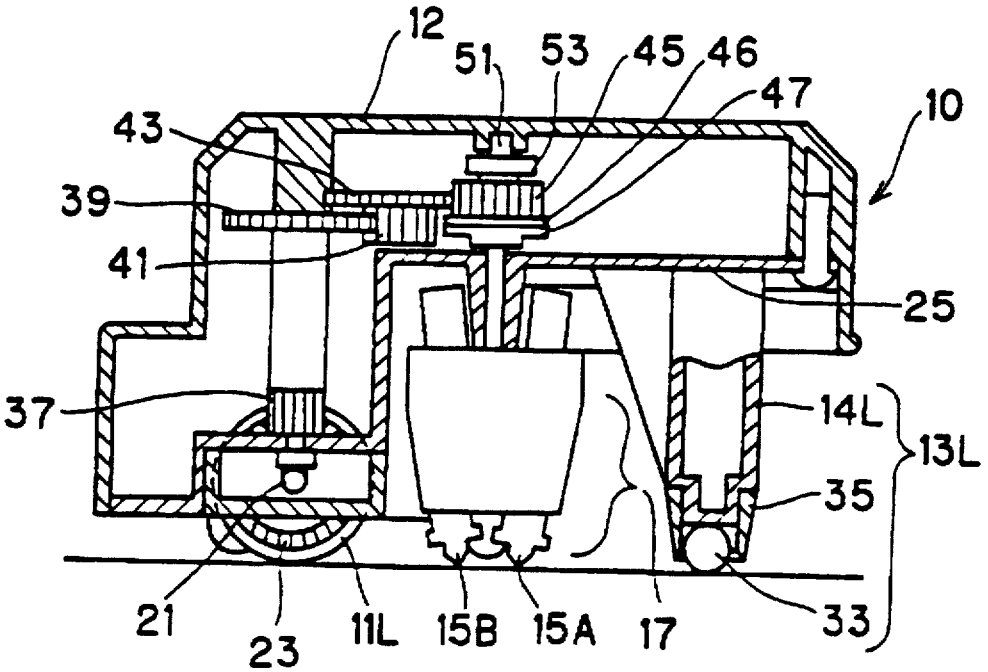
FIG. 4 is a partial cross-sectional view of the gear mechanism of the line-drawing toy in FIG. 1.

Gear 39 (32 teeth) is fitted to shaft 40 that penetrates hole 28 formed in curved surface 34 of base 25. Pinion 37 (10 teeth) is fitted to the bottom end of shaft 40. Gear 39 rotates in unison with pinion 37. As shown in FIGS. 3 and 4, crown gear 23 (28 teeth) of wheel 11L and pinion 37 are meshed together to rotate in unison.

Referring back to FIG. 2, a shaft of large-diameter gear 43 (32 teeth) and small-diameter gear 41 (14 teeth), which are formed as one unit, is rotatably positioned into a bearing (not illustrated) formed on the bottom face of cover 12 and bearing 42 formed on the top face of base 25. Small-diameter gear 41 meshes with gear 39. When small-diameter gear 41 rotates, large-diameter V gear 43 rotates in unison.

A hole 55 is formed in the top step of base 25 and is penetrated by shaft rod 51. A gear 45 (18 teeth) having a clutch mechanism is fitted to shaft rod 51 in the upper part of base 25. The large-diameter gear 43 meshes with gear 45. Pen part 17 is attached to shaft rod 51 in the lower part of base 25.

Figure 5:
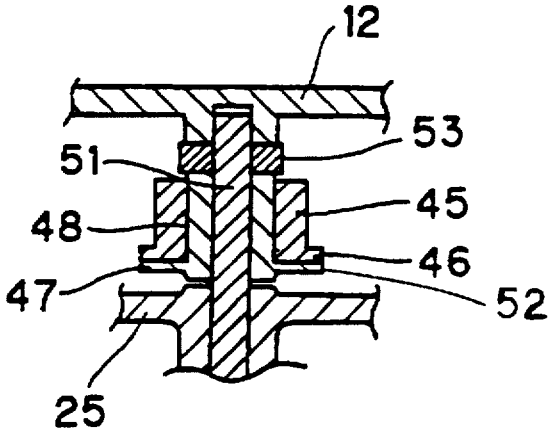
FIG. 5 is a partial cross-section of the clutch mechanism of the toy in FIG. 1.

FIG. 5 illustrates the clutch mechanism. Clutch member 47 is fitted to shaft rod 51. Clutch member 47 has small-diameter cylindrical part 48 at its top and large-diameter circular plate 52 at its bottom. Two protrusions 50, as illustrated in FIGS. 2, 6 and 7, are formed on a diametrical line on the top face of the larger-diameter circular plate 52. Protrusions 50 are in a half-cylindrical shape and are formed in the diametrical direction. Gear 45 has a hole in its center into which cylindrical part 48 of clutch member 47 fits. As illustrated in FIGS. 2, 6 and 7, the bottom of gear 45 widens into round plate 46 with two cutouts 49 on the diametrical line. Gear 45 is rotatably fitted over cylindrical part 48 of clutch member 47 and cutouts 49 are engageable to two protrusions 50 of clutch member 47.

As shown in FIGS. 6 and 8, gear 45 and clutch member 47 rotate as a unit when the two protrusions 50 engage with cutouts 49 in round plate 46. Shaft rod 51 rotates together with clutch member 47.

FIG. 5 illustrates that circular stopper plate 53 is fitted to shaft rod 51 and in contact with the top end of cylindrical part 48 of clutch member 47. Cylindrical part 48 is slightly higher than the top of gear 45. Therefore, gear 45 can move slightly upward. As illustrated in FIG. 7, when an abnormal force is imposed on gear 45 or clutch member 47, cutouts 49 of gear 45 override the curved surfaces of protrusions 50 of clutch member 47 and gear 45 rises up into contact with stopper plate 53 as shown in FIGS. 7 and 9. Therefore, engagement between gear 45 and clutch member 47 is released and gear 45 is no longer linked to shaft rod 51, to which clutch member 47 is fitted.

As illustrated in FIG. 2, top cover 59 of pen part 17 is fastened by screws 67 onto pen holder 57. Therefore, as shown in FIGS. 6 and 8, when the clutch mechanism is not operating and gear 45 rotates shaft rod 51, pen part 17 rotates together with shaft rod 51. As shown in FIGS. 7 and 9, when the clutch mechanism is in operation and gear 45 does not rotate shaft rod 51, rotation of pen part 17 is stopped. This prevents damage to the gear mechanism and pens when the toy is abused.

Figure 10:
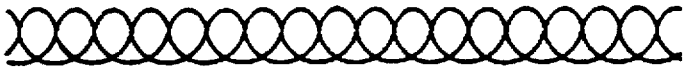
FIG. 10 is an example of a line drawn by the embodiment illustrated in FIG. 3 holding one pen.
Figure 11:
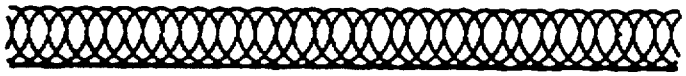
FIG. 11 is an example of lines drawn by the embodiment illustrated in FIG. 3 holding two pens.

To operate the line-drawing toy 10, the toy 10 is placed on a flat drawing surface. A hand is placed on cover 12 and toy 10 is moved in an optional direction. Spheres 33, at the bottom ends of leading supports 13L and 13R, rotate and toy 10 moves smoothly in the optional direction. Since the outer peripheries of wheels 11L and 11R are formed by elastic bodies 19L and 19R, wheels 11L and 11R rotate under friction with the drawing surface. Rotation of wheel 11L rotates crown gear 23 that is meshing with pinion 37 to transmit rotation to gear 39. Rotation of gear 39 is transmitted to gear 43 via gear 41. Rotation of gear 43 is transmitted to gear 45. Rotation of gear 45 rotates shaft rod 51 via clutch member 47 and rotates pen part 17 fixed at the bottom end of shaft rod 51. When one pen 61 is attached to pen part 17 and only pen tip 15A is present, the line shown in FIG. 10 is drawn. When two pens 61 are attached to pen part 17 and pen tips 15A and 15B are present, the lines shown in FIG. 11 are drawn. When abnormal force is imposed on the wheel rotation or motion of the pen tip, the clutch mechanism operates to avoid damage to the gear mechanism and, at such time, rotation of gear 45 is no longer transmitted to pen part 17 and the line drawn is a straight line.

Figure 13:
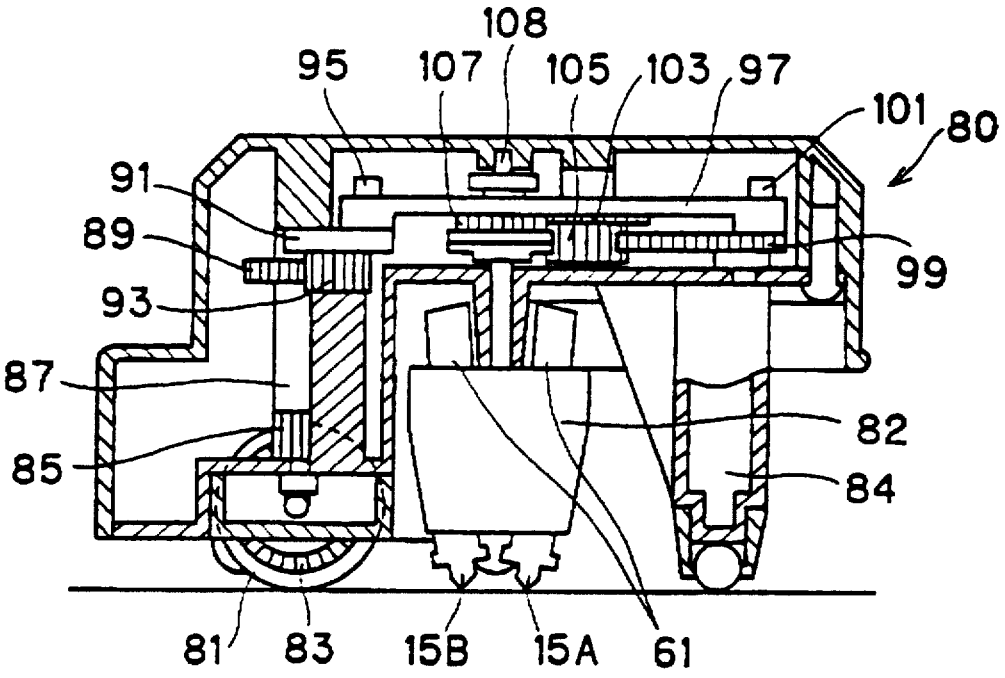
FIG. 13 is a partial cross-sectional view of the gear mechanism in FIG. 12.
Figure 14:
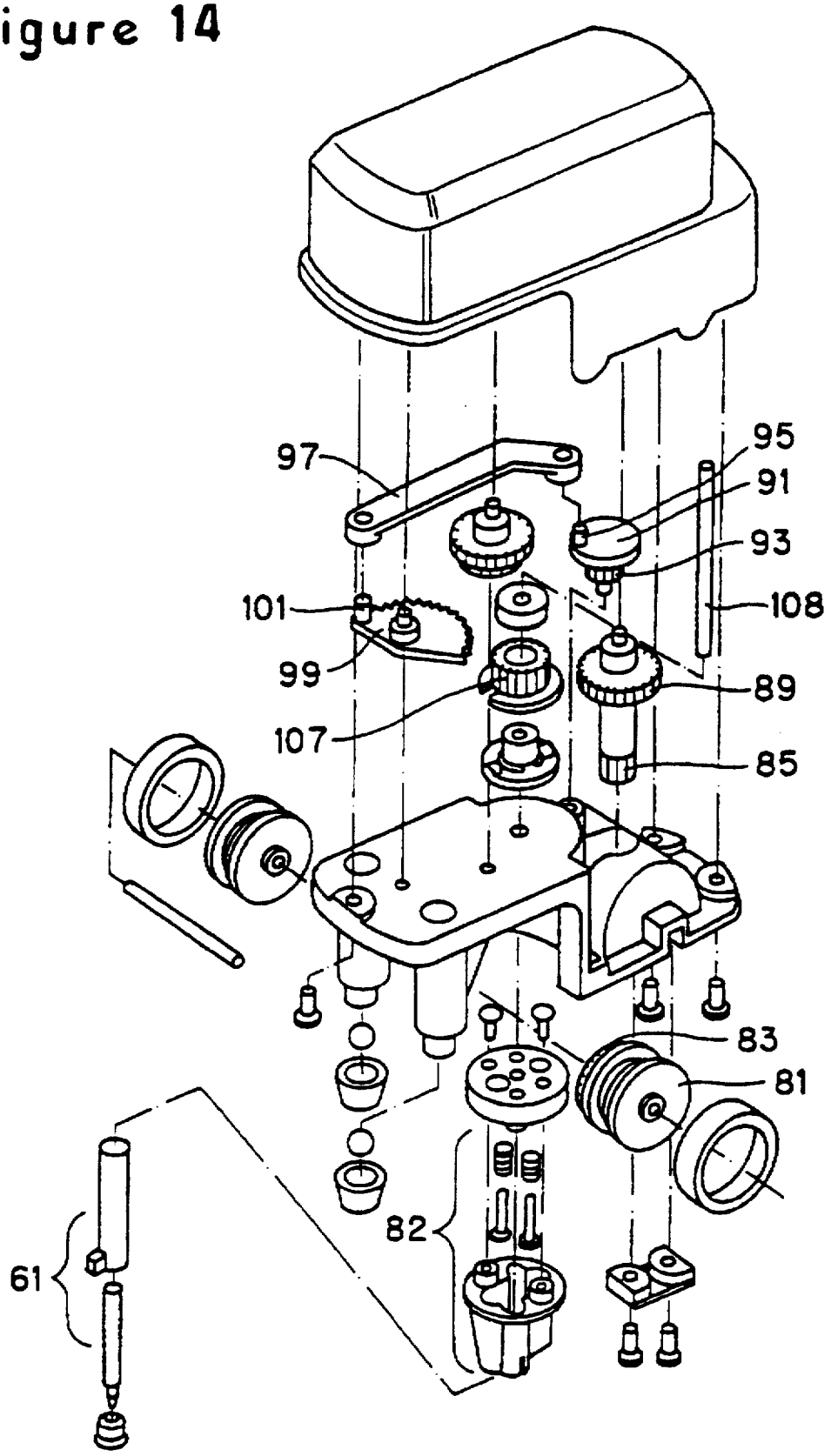
FIG. 14 is an exploded perspective view of the embodiment illustrated in FIG. 12.

Line-drawing toy 80, as illustrated in FIGS. 13 and 14, has the same appearance as line-drawing toy 10. Its wheels 81, pen part 82 and leading supports 84 are composed in the same manner as toy 10. The base and cover are also shaped similarly, but the position and shape of the bearings are changed as needed.

The gear mechanism of the line-drawing toy 80 is similar to line-drawing toy 10. As illustrated in FIG. 13, crown gear 83 (28 teeth) is disposed on the inside of wheel 81. Crown gear 83 meshes with pinion 85 (10 teeth). Gear 89 (24 teeth) is disposed on the top of shaft 87 that extends to the top part of pinion 85 where it rotates with pinion 85. Rotation of wheel 81 is transmitted to gear 89 (24 teeth) via pinion 85 (10 teeth) that is meshing with crown gear 83.

Figure 12:
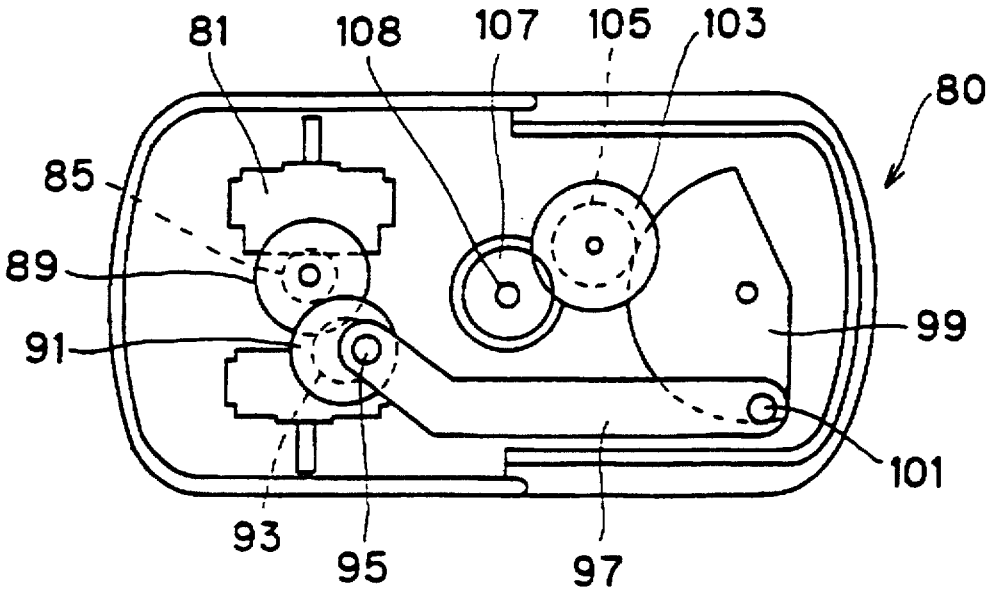
FIG. 12 is a top view of the gear mechanism of another embodiment of this invention.

In line-drawing toy 80, the rotary shaft of round plate 91 and gear 93 (12 teeth), formed as a unit, is rotatably fitted into the bearing formed in the top face of the base. As illustrated in FIGS. 12 and 14, gear 93 meshes with gear 89. When gear 93 rotates, round plate 91 also rotates as a unit. Shaft 95 protrudes from the top face of round plate 91, eccentrically to the rotary shaft. Long connecting member 97 has shaft holes at both of its ends. A hole at one end of long connecting member 97 is rotatably fitted to shaft 95. The hole at the other end of long connecting member 97 is fitted to a shaft 101 protruding from one end of the top face of sector gear 99 (56 teeth in total circumference).

When round plate 91 rotates, shaft 95 draws a 360° circular track together with one end of long connecting member 97. However, sector gear 99, connected to the other end of long connecting member 97, rotates in a clockwise angle, then rotates in the counterclockwise direction back to its original position in a reciprocating motion.

The rotary shaft of large-diameter gear 103 (26 teeth) and small-diameter gear 105 (16 teeth), formed as a unit, is fitted into the bearings formed on the top face of the base and the bottom face of the cover. Small-diameter gear 105 meshes with the sector gear 99. When sector gear 99 rotates clockwise, small-diameter gear 105 rotates counterclockwise, and when sector gear 99 rotates counterclockwise, small-diameter gear 105 rotates clockwise. When gear 105 rotates, gear 103 rotates in unison. Large-diameter gear 103 meshes with gear 107 (18 teeth) having a clutch mechanism.

Gear 107 with clutch mechanism has the same composition as gear 45 of line-drawing toy 10, and it is attached to rod shaft 108. Pen part 82 of the same composition as pen part 17 of line-drawing toy 10 is provided in the lower part of shaft rod 108.

To operate line-drawing toy 80, it is placed on a drawing surface. A hand is placed on the cover and toy 80 is moved in an optional direction. Wheel 81 with crown gear 83 rotates under friction with the surface. Rotation of wheel 81 is transmitted to gear 89 via pinion 85 that meshes with crown gear 83. Rotation of gear 89 is transmitted to round plate 91 via gear 93. Rotation of round plate 91 rotates sector gear 99 reciprocatingly about 36° via long connecting member 97, the reciprocating rotation of sector gear 99 reciprocatingly rotates small gear 105 and large gear 103 about 125°, and reciprocatingly rotates gear 107 that meshes with large gear 103 about 180°.

Figure 15:
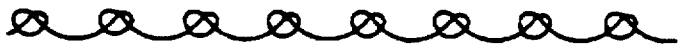
FIG. 15 is an example of a line drawn by the embodiment illustrated in FIG. 12 holding one pen.
Figure 16:
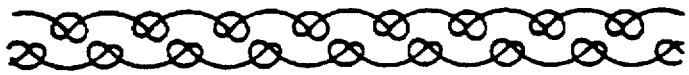
FIG. 16 is an example of lines drawn by the embodiment illustrated in FIG. 12 holding two pens.

Rotation of gear 107 is transmitted to shaft rod 108 via clutch mechanism onto pen part 82 fitted to the shaft rod and pen part 82 reciprocatingly rotates 180°. When one pen 61 is attached to pen part 82 with only pen tip 15A present, the line shown in FIG. 15 is drawn. When two pens 61 are attached to pen part 82 with pen tips 15A and 15B present, the lines shown in FIG. 16 are drawn.

Figure 17:
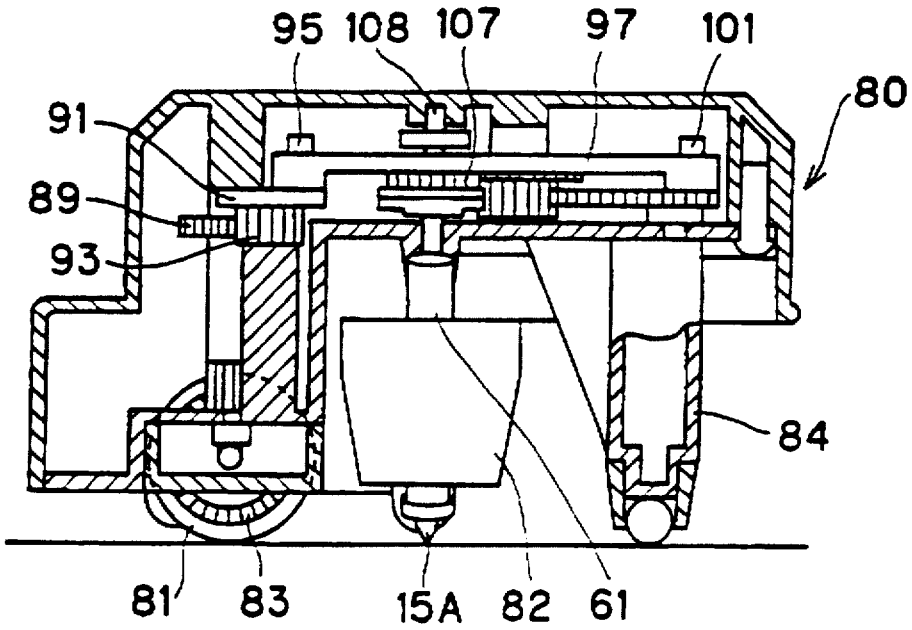
FIG. 17 is a side view of the gear mechanism of the embodiment illustrated in FIG. 12 depicting the pen part in a 90° offset from that illustrated in FIG. 13.
Figure 18:
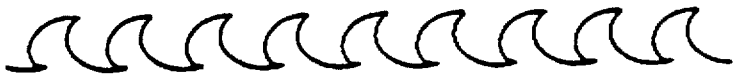
FIG. 18 is an example of a line drawn by the embodiment illustrated in FIG. 17 holding one pen.
Figure 19:
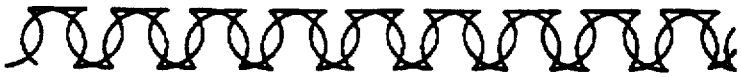
FIG. 19 is an example of lines drawn by the embodiment illustrated in FIG. 17 holding two pens.

FIG. 17 is a side view of the gear mechanism in which pen part 82 of line-drawing toy 80 is attached to shaft rod 108 in a90° offset from the above practical example. With this composition, when one pen 61 is attached to pen part 82 with only pen tip 15A present, the line shown in FIG. 18 is drawn. When two pens 61 are attached to pen part 82 with pen tips 15A and 15B present, the lines in FIG. 19 are drawn.

Figure 20:
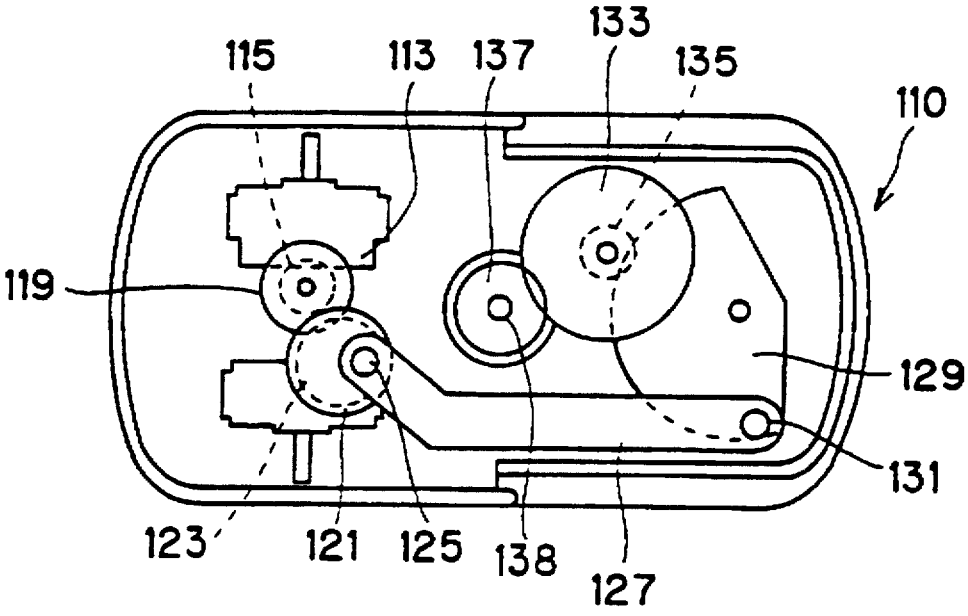
FIG. 20 is a top view of the gear mechanism of another embodiment of this invention.
Figure 21:
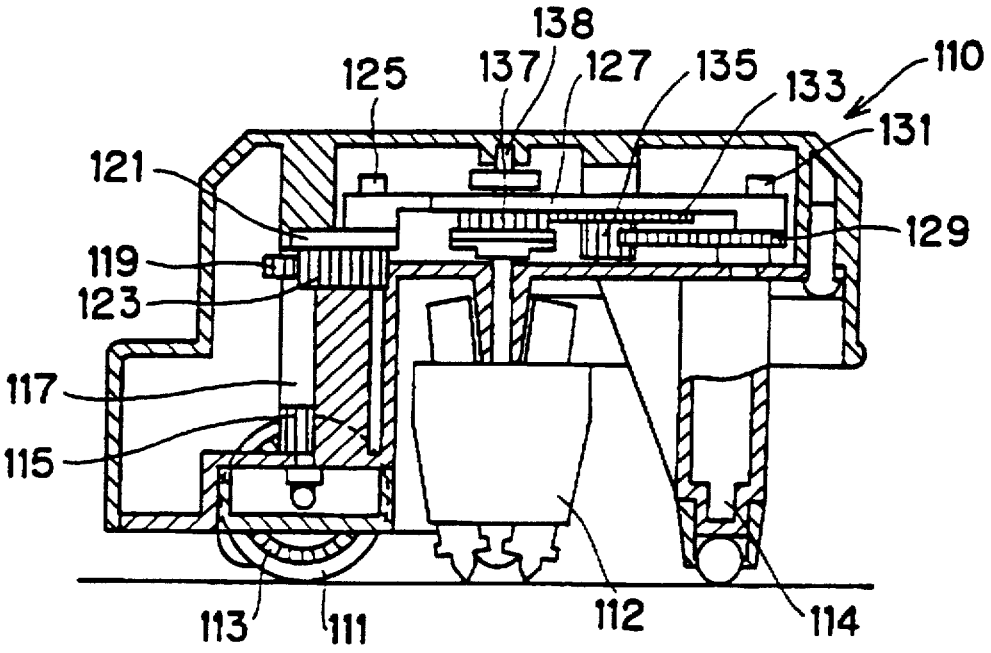
FIG. 21 is a side view of the embodiment illustrated in FIG. 20.

FIGS. 20 and 21 illustrate another embodiment of the line-drawing toy 110. Line-drawing toy 110 includes a gear mechanism having gears with a different number of teeth. Line-drawing toy 110 has the same appearance as line-drawing toy 80. Its wheels 111, pen part 112, and leading supports 114 are similarly composed. Its base and cover can have the same shapes as line-drawing toy 80.

In the gear mechanism, crown gear 113 (28 teeth) is disposed on the inside of wheel 111. Crown gear 113 meshes with pinion 115 (10 teeth). Gear 119 (18 teeth) is disposed on the top of shaft 117, which extends to the upper part of pinion 115. Gear 119 rotates together with pinion 115 similar to line-drawing toy 80.

In line-drawing toy 110, the rotary shaft of round plate 121 and gear 123 (18 teeth), formed as a unit, is rotatably fitted into the bearing formed on the top face of the base. Gear 123 meshes with gear 119.

When gear 123 rotates, round plate 121 also rotates as a unit. Shaft 125 protrudes from the top face of round plate 121, eccentrically to the rotary shaft. A hole at one end of long connecting member 127, having shaft holes at both of its ends, is rotatably fitted to shaft 125. The hole at the other end of long connecting member 127 is fitted to shaft 131, which protrudes from one end of the top face of sector gear 129 (54 teeth in total circumference).

When round plate 121 rotates, shaft draws a 360° circular track together with one end of long connecting member 127. However, sector gear 129 connected to the other end of long connecting member 127 rotates at a certain angle clockwise, then rotates counterclockwise back to the original position, in reciprocation.

The rotary shaft of large-diameter gear 133 (36 teeth) and small-diameter gear 135 (10 teeth), formed as a unit, is rotatably fitted into bearings formed on the top face of the base and the bottom face of the cover. Small gear 135 meshes with the sector gear 129. When sector gear 129 rotates clockwise, small gear 135 rotates counterclockwise. When sector gear 129 rotates counterclockwise, small gear 135 rotates clockwise. When small gear 135 rotates, large gear 133 rotates as a unit. Large gear 133 meshes with gear 137 (18 teeth) having a clutch mechanism.

Gear 137 with clutch mechanism has the same composition as gear 45 of line-drawing toy 10. Gear 137 is attached to shaft rod 138. Pen part 112, which has the same composition as pen part 17 of line-drawing toy 10, is provided in the lower part of shaft rod 138.

To operate line-drawing toy 110, toy 110 is placed on a drawing surface. A hand is placed on the cover for movement of toy 110 in an optional direction. Wheel 111 including crown gear 113, rotates under friction with the surface. Rotation of wheel 111 is transmitted to gear 119 via pinion 115, which meshes with crown gear 113. Rotation of gear 119 is transmitted to round plate 121 via gear 123.

Rotation of round plate 121 rotates sector gear 129 reciprocally about 33.3° via long connecting member 127. Reciprocating rotation of sector gear 129 rotates small gear 135 and large gear 133 reciprocally about 180°, and it rotates gear 137 meshing with large gear 133, reciprocally, about 360°.

Figure 22:
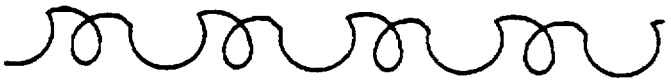
FIG. 22 is an example of a line drawn by the embodiment illustrated in FIG. 20.
Figure 23:
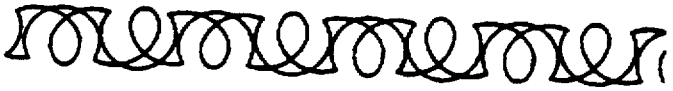
FIG. 23 is an example of lines drawn by the embodiment illustrated in FIG. 20.

Rotation of gear 137 is transmitted to shaft rod 138 via the clutch mechanism, then to pen part 112 fitted to the shaft rod, which rotates pen part 112 reciprocally 360°. When one pen 61 is attached to pen part 112 and only pen tip 15A is present, the line shown in FIG. 22 is drawn. When two pens 61 are attached to pen part 112 and pen tips 15A and 15B are present, the lines shown in FIG. 23 are drawn.

As explained above, entirely different line tracks can be drawn by having a different number of teeth, or by the pen tip(s) of the pen part having a different layout, even when all other compositions are the same. The patterns can further be changed by using three or more pen tips or a different combination of meshing gears.

The foregoing detailed description has been provided for clearness of understanding the embodiments of the invention depicted in the drawings and should not be considered as unduly limiting the scope of the claims herein.

What is claimed:

1. A line-drawing toy comprising:

a base;

a wheel rotatably joined to the base that rotates under friction with a contact surface;

a leading support joined to the base and spaced apart from the wheel, the leading support for supporting the base above a contact surface;

a pen part operatively joined to the base between the leading support and the wheel, the pen part including at least one pen tip for drawing a line on a contact surface; and a gear mechanism operatively joined to the pen part and the wheel, the gear mechanism having an intermeshing gear assembly for converting the rotary motion of the wheel into a predetermined pattern of the pen tip.

2. The line-drawing toy of claim 1, in which the leading support includes freely rotatable spheres for contacting a contact surface.

3. The line-drawing toy of claim 1, further comprising means for converting the rotary motion of the wheel in one direction into a reciprocal rotary motion in the pen part.

4. The line-drawing toy of claim 1, in which the gear mechanism includes a clutch mechanism.

5. A line-drawing toy comprising:

a base;

a wheel rotatably joined to the base that rotates under friction with a contact surface;

a leading support joined to the base and spaced apart from the wheel, the leading support for supporting the base above a contact surface;

a pen part operatively joined to the base between the leading support and the wheel, the pen part including at least one pen tip for drawing a line on a contact surface; and a gear mechanism operatively joined to the pen part and the wheel, the gear mechanism comprising:

a crown gear disposed on the wheel;

a gear;

means for meshing the crown gear and the gear; and a shaft joined to the gear for rotation therewith, and having means for rotating the pen part.

6. A line-drawing toy comprising:

a base;

a wheel rotatably joined to the base that rotates under friction with a contact surface;

a leading support joined to the base and spaced apart from the wheel, the leading support for supporting the base above a contact surface;

a pen part operatively joined to the base between the leading support and the wheel, the pen part including at least one pen tip for drawing a line on a contact surface; and a gear mechanism operatively joined to the pen part and the wheel, the gear mechanism having means for converting the rotary motion of the wheel into a reciprocal rotary motion in the pen part, said means comprising:

a gear for rotating in one direction;

a lever arm having a first end and a second end, the first end eccentrically joined to the gear; and a sector gear joined to the second end of the lever arm.

* * * * *